US007810890B2

(12) United States Patent
Klein et al.

(10) Patent No.: US 7,810,890 B2
(45) Date of Patent: Oct. 12, 2010

(54) GLIDE MECHANISM FOR ROLL OUT DRAWERS AND OTHER ITEMS

(75) Inventors: Richard B. Klein, Overland Park, KS (US); Mark A. Etter, Independence, MO (US)

(73) Assignee: Lynk, Inc., Lenexa, KS (US)

( * ) Notice: Subject to any disclaimer, the term of this patent is extended or adjusted under 35 U.S.C. 154(b) by 668 days.

(21) Appl. No.: 11/549,485

(22) Filed: Oct. 13, 2006

(65) Prior Publication Data

US 2008/0088213 A1 Apr. 17, 2008

(51) Int. Cl.
*A47B 88/00* (2006.01)

(52) U.S. Cl. ..... 312/334.33; 312/330.1; 312/334.6; 312/334.32; 312/334.34

(58) Field of Classification Search ..... 312/228.1, 312/330.1, 334.1, 334.6, 334.27, 336.31, 312/334.32, 334.33, 334.34, 334.36, 334.13, 312/334.14, 402, 410; 211/26, 88.01, 90.01, 211/126.15, 151, 126.9, 133.2, 133.5, 41.4, 211/41.8, 181.1; 248/175, 580, 581, 635, 248/562; 220/485, 489, 495; 411/424, 535, 411/536, 544, 546, 907, 908; 16/94 R; 267/140.3, 267/153, 141; 206/561
See application file for complete search history.

(56) References Cited

U.S. PATENT DOCUMENTS

| | | | | | |
|---|---|---|---|---|---|
| 409,696 | A | * | 8/1889 | Motherwell | 411/424 |
| 461,621 | A | * | 10/1891 | Rogers | 411/424 |
| 676,240 | A | * | 6/1901 | Latty | 411/424 |
| 1,692,805 | A | * | 11/1928 | Andersson | 312/334.13 |
| 1,876,640 | A | * | 9/1932 | Dobson | 248/635 |
| 2,006,169 | A | * | 6/1935 | Harris-Jones | 4/559 |
| 2,019,052 | A | * | 10/1935 | Lord | 267/140.3 |
| 2,142,897 | A | * | 1/1939 | Harmon | 312/334.19 |
| 3,056,641 | A | * | 10/1962 | Parmet | 312/334.37 |
| 3,349,942 | A | * | 10/1967 | Hitz | 220/494 |
| 3,726,581 | A | * | 4/1973 | Doepke | 312/351 |
| 3,813,069 | A | * | 5/1974 | Fletcher | 248/188.1 |
| 3,850,392 | A | * | 11/1974 | Gassaway | 248/553 |
| 4,014,588 | A | * | 3/1977 | Kohriyama | 296/35.1 |

(Continued)

OTHER PUBLICATIONS

Non-Final Office Action dated Jul. 21, 2009, in U.S. Appl. No. 11/766,438 entitled Storage Rack for Pot and Pan Lids; filed Jun. 21, 2007; Applicant: Klein, Richard B.

*Primary Examiner*—Janet M Wilkens
*Assistant Examiner*—Dan Rohrhoff
(74) *Attorney, Agent, or Firm*—Hovey Williams LLP

(57) ABSTRACT

A slide frame mechanism for a rollout accessory such as a wire drawer has two or more ball-bearing glides in a vertical orientation. Each of the glides includes a glide mount with a threaded aperture and cross-bars attached to extend between the glides. The accessory has a plurality of mounting tabs. Shoulder screws with partial threads pass through the accessory mounting tabs and threadably engage the threads of the slide mount apertures to secure the accessory to the glides. A compressible pad is positioned between the accessory mounting tabs and the glide mounts to provide a floating suspension which reduces binding of the glides when the accessory is rolled in and out. The screws fit loosely through oversized openings in the mounting tabs to allow limited movement of the accessory relative to the glides in a horizontal plane for further reduction of binding. Drawer dividers are constructed to detachably fit on drawers to provide separate compartments.

17 Claims, 16 Drawing Sheets

U.S. PATENT DOCUMENTS 4,062,585 A * 12/1977 Herring, Jr. ..... 297/195.1
4,146,139 A * 3/1979 von Stein et al. ..... 211/126.9
4,215,841 A * 8/1980 Herring, Jr. ..... 248/635
4,416,446 A * 11/1983 Murakami ..... 267/140.3
4,723,743 A * 2/1988 Jenkins ..... 248/97
4,759,341 A * 7/1988 McFarland ..... 126/339
4,806,437 A * 2/1989 Yokoi et al. ..... 428/623
4,824,314 A * 4/1989 Stencel ..... 411/378
4,858,880 A * 8/1989 Durand ..... 248/635
4,871,208 A * 10/1989 Hodgdon ..... 297/303.1
4,881,826 A * 11/1989 Grass ..... 384/19
4,932,729 A * 6/1990 Thompson et al. ..... 312/405
4,995,598 A * 2/1991 Ingham ..... 267/293
4,995,682 A * 2/1991 Gutner ..... 312/311
5,000,480 A * 3/1991 Straka et al. ..... 280/756
5,044,587 A * 9/1991 Degen ..... 248/158
5,086,936 A * 2/1992 Remmers ..... 211/126.15
5,230,554 A * 7/1993 Camilleri ..... 312/334.6
5,330,063 A * 7/1994 Remmers ..... 211/162
5,342,106 A * 8/1994 Fischer ..... 296/204
5,524,860 A * 6/1996 Ives ..... 248/674
5,649,740 A * 7/1997 Hodgdon ..... 297/303.1
5,919,020 A * 7/1999 Walther ..... 411/399
6,039,422 A * 3/2000 Butters et al. ..... 312/334.1
6,142,596 A * 11/2000 Carson ..... 312/334.39
6,231,138 B1 * 5/2001 Janson ..... 312/201
D445,766 S * 7/2001 Solomon ..... D13/199
6,390,576 B1 * 5/2002 Walburn ..... 312/348.4
6,394,567 B1 * 5/2002 Welch ..... 312/334.41
6,474,484 B1 * 11/2002 Miller, Jr. ..... 211/162
7,237,246 B2 * 6/2007 Chang ..... 720/692
2002/0124348 A1 * 9/2002 Compagnucci ..... 16/94 R
2005/0001522 A1 * 1/2005 Yang ..... 312/330.1
2005/0214099 A1 * 9/2005 Silvestro et al. ..... 411/424
2006/0254190 A1 * 11/2006 Hunt ..... 52/698
2007/0018545 A1 1/2007 Calabria et al.
2007/0241599 A1 * 10/2007 Hodgdon ..... 297/313
2007/0278360 A1 * 12/2007 Chen ..... 248/121

* cited by examiner

GLIDE MECHANISM FOR ROLL OUT DRAWERS AND OTHER ITEMS

CROSS-REFERENCE TO RELATED APPLICATIONS

None.

BACKGROUND OF THE INVENTION

Ball-bearing glides used in connection with drawers and other accessories are encumbered by a number of shortcomings, many of which can result in premature product failure. One such shortcoming involves glide alignment. Ball-bearing glides are difficult for ordinary consumers to install properly and often require professional installation which is not practical for a consumer product. Even when installed skillfully, the glides are usually out of exact alignment in some direction. Humidity changes and other external factors can cause misalignment or exacerbate already existing misalignment of ball-bearing glides. If an accessory such as a drawer is installed onto glides that are not exactly aligned in all directions, the drawer will not operate properly due to the glides binding.

Ball-bearing drawer glides are sometimes installed with the glides oriented horizontally. Because of the horizontal orientation, there is little structural resistance to vertical deflection and the glides bend when the accessory is extended to the open position, particularly if under heavy loads. Once the glides become bent, the accessory will inevitably bind thereafter.

Ball-bearing glides have in some applications been installed in a vertical configuration. Unfortunately, just installing the glides in a vertical arrangement does not by itself solve the binding problem. While vertically oriented glides tend to suffer less deflection than horizontally mounted glides, even glides that are installed in a vertical orientation are susceptible to binding for the reasons previously given. If one or more of the fasteners used to fasten the glides to the accessory are tighter than others or installed at an angle or an imprecise location, the fasteners cause misalignment of the glides. Again, even a small amount of bending, skewing or other misalignment of the glides creates binding.

Ball-bearing glides with full extension, even when professionally installed in a rigid manner, experience a high rate of product failure. When an accessory equipped with a full extension glide is fully or nearly fully extended, the leverage exerted on the glides by the fully extended weight can create bending of the glides or even cause detachment of the fasteners attaching the glides to the cabinet.

SUMMARY OF THE INVENTION

The foregoing problems are successfully addressed, to a great extent, by the present invention, wherein in one aspect, a glide frame mechanism for rollout accessories may be provided with a pad preferably interposed between the accessory and the glide mount. The pad provides a floating suspension which largely eliminates the binding that has plagued prior rollout accessories.

The invention also contemplates, in another aspect, mounting of the accessory to the glide in a manner to accommodate relative movement or "play" of the accessory in a generally horizontal plane to reduce or eliminate binding. This can be accomplished in various ways, including the provision of an oversized opening for receiving a fastener used to connect the accessory with the glide.

In accordance with another aspect of the present invention, a glide frame mechanism for rollout accessories is provided with two or more glides in a vertical orientation and a cross connector such as a bar which maintains the glides parallel to one another.

In accordance with still another aspect of the invention, a glide frame mechanism for rollout accessories may be provided with pads which are strategically mounted at locations to assure smooth and repeatable movement of the accessory in and out.

In accordance with yet another aspect of the invention, a rollout accessory glide mechanism may make use of special fasteners that prevent over-tightening which could unduly compress the pads and detract from their ability to provide a floating suspension that maintains smooth gliding motion of the accessory.

In accordance with still another aspect of the invention, a divider for partitioning a drawer may take the form of a wire frame that is provided on its opposite ends with a hook or saddle-like profile arranged to hook onto edges of a drawer to hold the divider in place. This construction adequately secures the divider in place and yet allows it to be adjusted in position on the drawer without the need for tools, fasteners or other complications.

In accordance with still another aspect of the invention, the hook or saddle areas of the divider may be provided with a friction coating to enhance the frictional holding force of the hook or saddle areas.

One embodiment of the invention may take the form of a ball-bearing glide system with vertical glides and cross connectors such as cross bars which maintain a parallel relationship of the glides as is necessary for smooth gliding. An important feature of this embodiment is the use of cushions or pads preferably located between the glides and the drawer or other accessory, providing a floating type suspension that resists binding. Special fasteners, such as shoulder screws that may be used to connect the parts, are only partially threaded and provide a limit when the threads bottom out to prevent the pads from becoming overly compressed such they would not be able to function properly. Other fasteners that provide the same functionality may be used as well.

Another feature is that the glide frame may be first mounted to the cabinet and the accessory may thereafter be connected with the glides. This prevents the accessory from being in the way and interfering with access during installation of the glides in the cabinet which is often a small space.

Another feature of the invention is a drawer divider which can be installed in any number and at any position within the drawer to provide separate, selectively sized and positioned compartments within a drawer. The divider also may prevent taller items from tipping when the drawer is being closed or opened.

Certain embodiments of the invention are outlined above in order that the detailed description thereof may be better understood, and in order that the present contributions to the art may be better appreciated. In this respect, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention. Though some features of the invention may be claimed in dependency, each feature has merit when used independently.

BRIEF DESCRIPTION OF THE SEVERAL VIEWS OF THE DRAWING

Further features of the present invention will become apparent to those skilled in the art to which the present invention relates from reading the following description with reference to the accompanying drawings, in which.

DESCRIPTION OF THE PREFERRED EMBODIMENT

Figure 1:
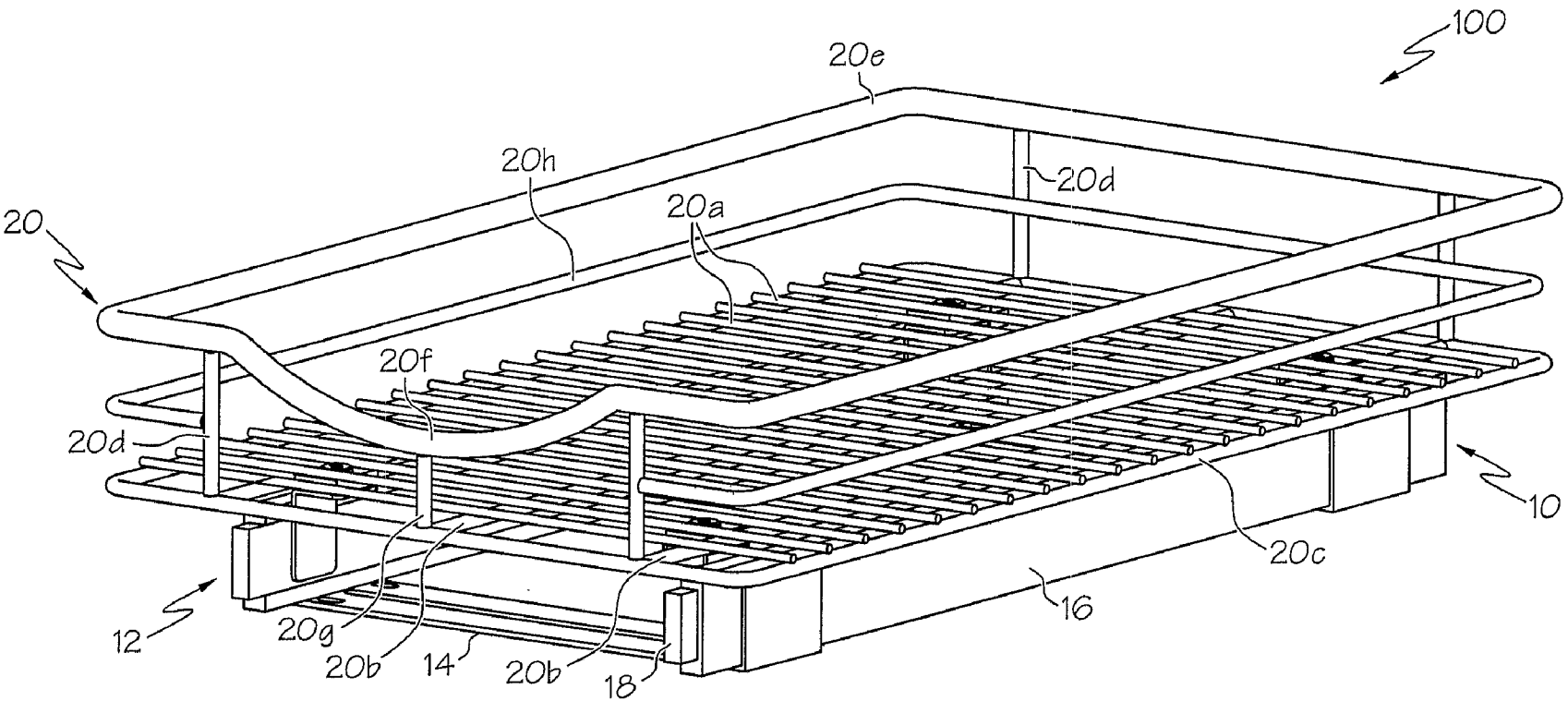
FIG. 1 is a perspective view of a drawer and glide frame mechanism for rollout drawers according to a preferred embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the Figures. Instead, the sizes of certain small components have been exaggerated for illustration.

FIG. 1 is a perspective view of a drawer and glide frame mechanism for a rollout drawer 100 according to one embodiment of the present invention. A glide frame 10 includes one or more vertically oriented glides 12 connected to one or more cross-bars 14. Each glide 12 includes a track 16 which houses a runner 18 that is slideably connected to the track 16 and can extend out of and retract into the track using a ball-bearing system (not shown) of the type commonly used for drawer glides. The tracks 16 of the glides 12 are rigidly attached to one or more of the cross-bars 14 in a generally perpendicular arrangement to the cross-bars 14 which gives the glide frame 10 a generally rectangular arrangement. The cross-bars 14 keep the glides 12 generally parallel to each other. The glide frame 10 may be connected to a drawer 20. It will be appreciated by one skilled in the art that while the glide frame 10 is illustrated with a drawer 20, the glide frame 10 may be used with any number of accessories or other objects including but not limited to bins, shelving, racks, platforms, containers, and the like.

The drawer 20 may have a wire construction including a bottom formed by lateral wires 20*a* and larger longitudinal wires 20*b*. Wires 20*a* extend across and are connected to opposite sides of a bottom rim 20*c*. Wires 20*b* extend between and are connected to front and back parts of the bottom rim 20*c*. The drawer 20 includes upright posts 20*d* which extend upwardly from the front and back parts of bottom rim 20*c*. A wire top rim 20*e* is connected with the upper ends of upright posts 20*d* and extends around the top edge of the drawer 20 to provide an open top. The front portion of the top rim 20*e* is curved downwardly as indicated at 20*f* with a short post 20*g* connecting to the center of the portion 20*f*. A center wire 20*h* is connected with the posts 20*d* between the bottom rim 20*c* and the top rim 20*e* and extends horizontally along the sides and back of the drawer 20 and partially along the front of the drawer on the drawer periphery to help retain items placed on the bottom of the drawer 20.

The bottom of the drawer 20 includes a drawer tab 22 (see FIG. 2) which is connected to one or more wires on the bottom of the drawer 20. According to one embodiment of the present invention, the drawer tab 22 is attached to the bottom of the drawer 20 by welding the drawer tab 22 to a pair of adjacent lateral wires 20*a* at a location adjacent to one of the longitudinal wires 20*b*. The tab 22 is preferably secured to the lower surfaces of the wires 20*a* so that it is on the underside of the drawer bottom where it does not interfere with items held in the drawer.

The drawer tab 22 includes an aperture 24. The drawer tab aperture 24 may be elongated such that it is longer in its side-to-side dimension than in its front-to-back dimension. A pad 26 may be attached to drawer tab 22 so that the pad 26 is located on the underside of the drawer 20 and tab 22 when the drawer is upright. The pad 26 includes an aperture 28 that may be elongated side-to-side and is generally aligned with the drawer tab aperture 24. The pad 26 may be attached to the drawer tab 22 using conventional techniques such as those making use of adhesive, or the pad may be loose and attached by various means, including a fastener as will be explained. The pad 26 is preferably compressible and may be comprised of foam, cork, sponge, rubber or other compressible or semi-compressible material.

Figure 3:
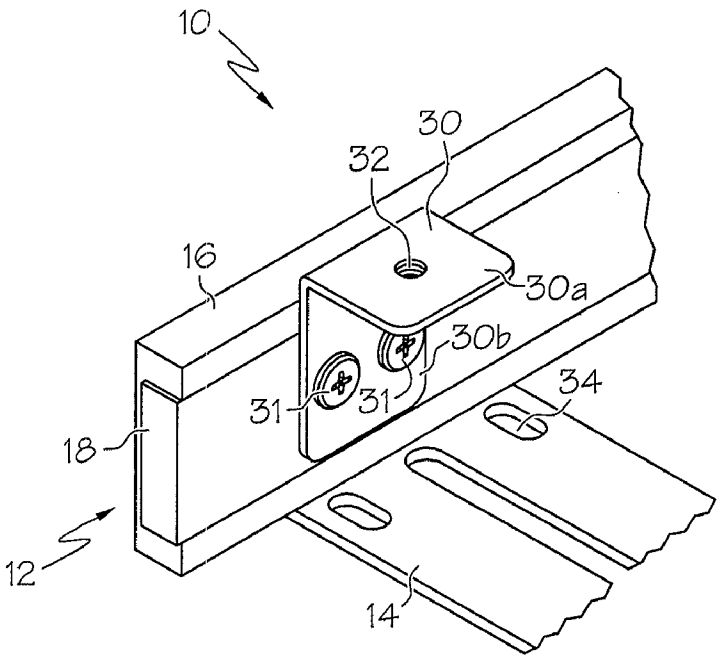
FIG. 3 is a fragmentary perspective view on an enlarged scale of a portion of the glide frame of FIG. 1.

As best shown in FIG. 3, the runner 18 is provided with a glide mount 30 which may take the form of an angle bracket.

The upper plate 30*a* of the glide mount 30 projects inwardly from the glide 12. The glide mount 30 may be attached to the runner 18 in any number of ways including screws, bolts, rivets, welding, or other means. As shown in FIG. 3, screws 31 may be used to connect the lower plate 30*b* of the glide mount 30 to the inside face of runner 18. The upper plate 30*a* of the glide mount 30 is positioned slightly above the track 16 and is generally parallel to the top face of the cross-bar 14. The glide mount 30 is provided with an aperture 32 in plate 30*a* that may be threaded. Each cross-bar 14 includes one or more apertures 34 which may be used to secure the glide frame 10 in a desired location, such as the interior of a cabinet.

Figure 4:
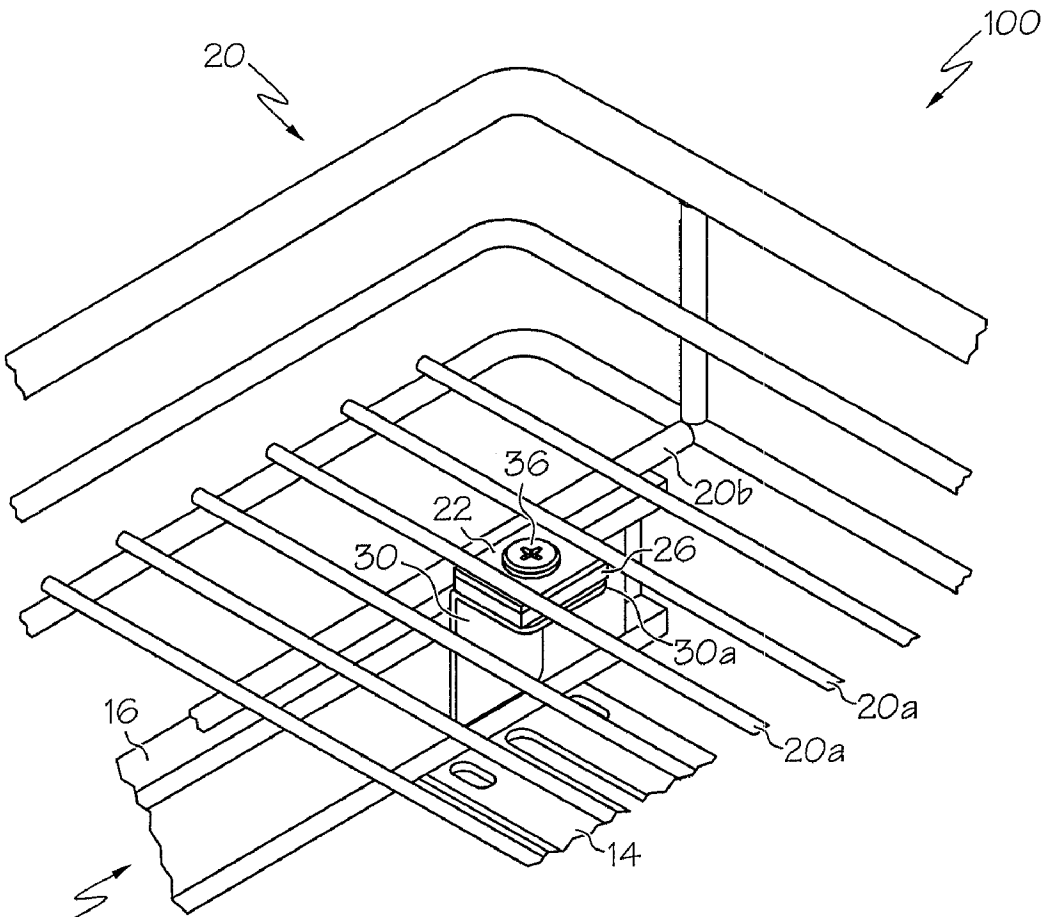
FIG. 4 is a fragmentary perspective view on an enlarged scale of a corner portion of the drawer and glide frame mechanism for rollout drawers of FIG. 1.

As best shown in FIG. 4, the drawer 20 is preferably connected to the glide frame 10 using a special fastener such as a shoulder screw 36 that connects the drawer tab 22 to the glide mount 30. The pad 26 may be positioned between the drawer tab 22 and the glide mount plate 30*a* so the drawer tab 22 is physically separated from the glide mount 30 when connected by the screw 36. The pad 26 between the drawer tab 22 and the glide mount 30, being compressible, provides a floating suspension between the drawer 20 and the glide frame 10. The benefit of a glide frame mechanism with a floating suspension is that the pad 26 has enough "give" or "play" that it prevents binding of the glides when the drawer 20 is moved along the glides 12. In this way, the pad 26 compensates for any slight misalignments or other imperfections that might otherwise cause binding.

Problems causing binding of the glides can arise from at least five different sources. First, if the fasteners such as screws which fasten the glide frame to the cabinet or other support are tightened unevenly, installed at a slight angle, or otherwise applied incorrectly, the glides are misaligned enough to cause binding. Second, there is inevitably misalignment of the glide frame in one or more directions no matter how carefully or skillfully the glide frame is installed to a cabinet or other mounting surface, due to factors such as a warped or otherwise uneven mounting surface, swelling of the mounting surface due to humidity changes, or a wide variety of additional imperfections that are inevitably present. Third, the drawer or other accessory can be connected improperly to the glides, causing the glides to be skewed, bent, curved or otherwise displaced from a precisely aligned arrangement. Fourth, manufacturing tolerances can vary enough that they create binding. Fifth, the weight and location of stored items in the drawer or other accessory can create binding. By using the pad 26 to provide a floating suspension, any binding that might otherwise occur for any of these reasons is avoided due to the "play" or "give" in the floating suspension.

Figure 5A:
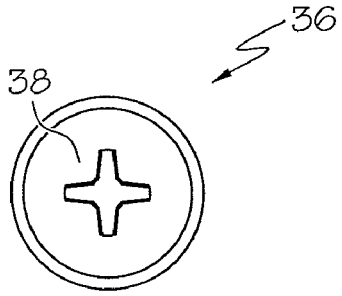
FIGS. 5A & 5B show a shoulder screw fastener according to an embodiment of the present invention in top and side elevational views, respectively.
Figure 5B:
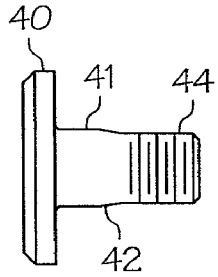
Figure 6:
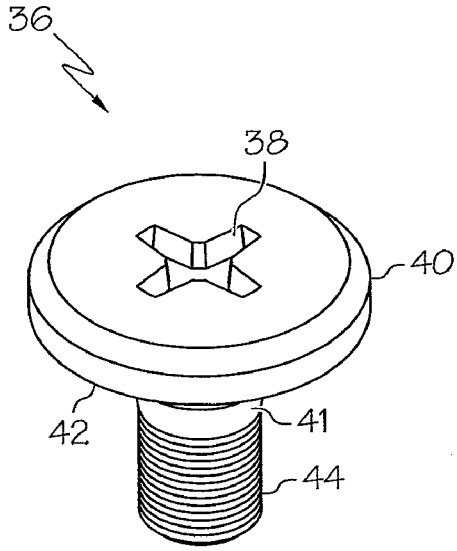
FIG. 6 is a perspective view of the fastener of FIGS. 5A & 5B.

FIGS. 5A, 5B and 6 shows a shoulder screw 36 that may be used according to one embodiment of the present invention. The screw 36 may have a (Phillips) cross drive head 38, but it will be appreciated by those of skill in the art that the fastener may include other drive configuration interfaces. As best shown in FIG. 5B, the screw 36 is preferably only partially threaded on its shank 41. A substantially flat screw head 40 sits above a shoulder 42 which is not threaded and is of a greater diameter than the portion of the screw with threads 44.

Applying the shoulder screws 36 involves extending the shanks 41 through the aperture 24 and 28 and threading the threaded tips of the screws into the threaded apertures 32 of the glide mounts 30, with the pads 26 sandwiched between tab 22 at the top and plate 30*a* at the bottom. The travel of the screws 36 is limited by the shoulders 42 bottoming out on the plate 30*a*. Consequently, the pads 26 may be compressed no more than they are when the shoulders 42 bottom out, and the compression of each pad is controlled and limited in this way. The length of the bare screw shank 41 is selected to effect the desired compression of the pads. Fasteners and other means that differ from the shoulder screws, yet limit the compression of pads 26, can also be used.

As best shown in FIG. 4, the screw heads 36 are recessed such that they do not project or protrude above the upper surfaces of the wires 20*a* on which items rest when stored in the drawer 20. By attaching the tabs 22 to the lower surfaces of wires 20*a* and providing a flat, low-profile screw head 36, the entirety of the fastening system is recessed below the upper surfaces of wires 20*a* so that items stored in the drawer are not scratched, marred or otherwise damaged or impeded by the fastening system, and fingers cannot be gouged by protruding fasteners or sharp edges.

Figure 2:
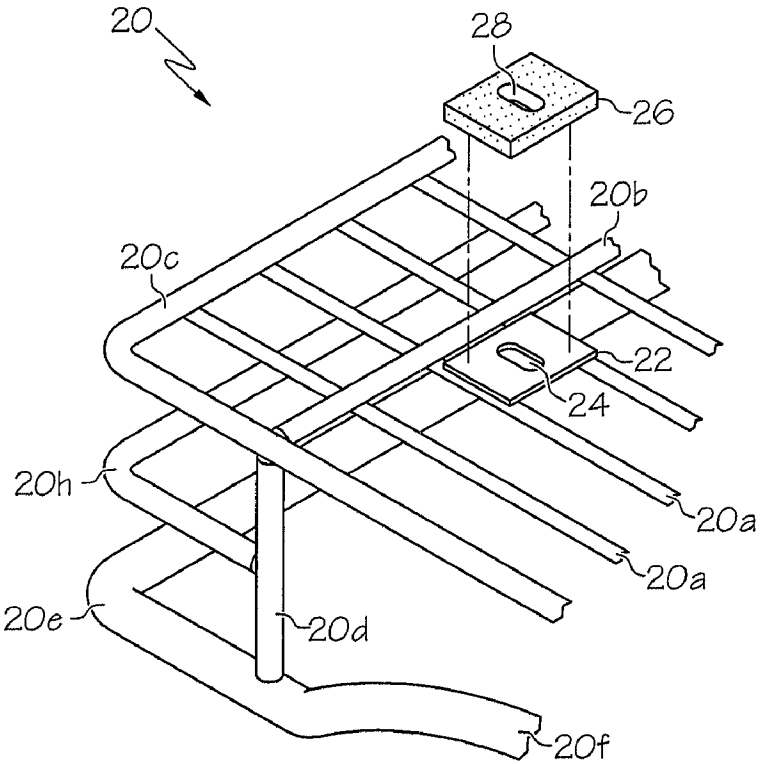
FIG. 2 is a fragmentary perspective view on an enlarged scale of a bottom corner portion of the drawer of FIG. 1.

In addition to the floating connection provided by the pad 26, the drawer or other accessory is also mounted in a manner allowing it to move to a limited extent relative to the glide frame in a generally horizontal plane. This can be accomplished in various ways. For example, the aperture 24 can be elongated or otherwise oversized relative to the shank 41 of screw 36. Preferably, aperture 24 is elongated in a side-to-side direction as best shown in FIG. 2. This allows tab 22 and the drawer or other accessory to move from side to side relative to the glide mount 30 and the glide frame, limited by the travel of the screw shank 41 between the ends of the elongated aperture 24. The front-to-back dimension of aperture 24 is also preferably oversized relative to the screw shank so that tab 22 and the drawer or other accessory can move in the front to back direction relative to the glide mount 30 and the glide frame.

While aperture 24 may be elongated in its side-to-side dimension and oversized in its front-to-back dimension as described, other means and techniques can be used to allow the drawer or other accessory to move in a generally horizontal plane relative to the runner 18 on which it is mounted. By allowing limited relative vertical movement of the accessory as a result of the spacing between the tab 22 and glide mount 30 (with or without pad 26 interposed therebetween), and limited relative horizontal movement of the accessory as a result of the loose fit of screw 36 in aperture 24, the accessory can move relative to the glide frame in any direction (along two horizontal axes and one vertical axes and at any angle between any of these axes), thereby accommodating for misalignment of the glide which inevitably occurs. The three dimensional "play" provided by this invention avoids a rigid connection and overcomes all of the binding problems previously mentioned. At the same time, the "play" is limited in all directions and the pad preferably provides a floating suspension that prevents rattling or other noise and gives the assembly a smooth feel as well as a smooth sliding action as the accessory is moved in and out.

Figure 9:
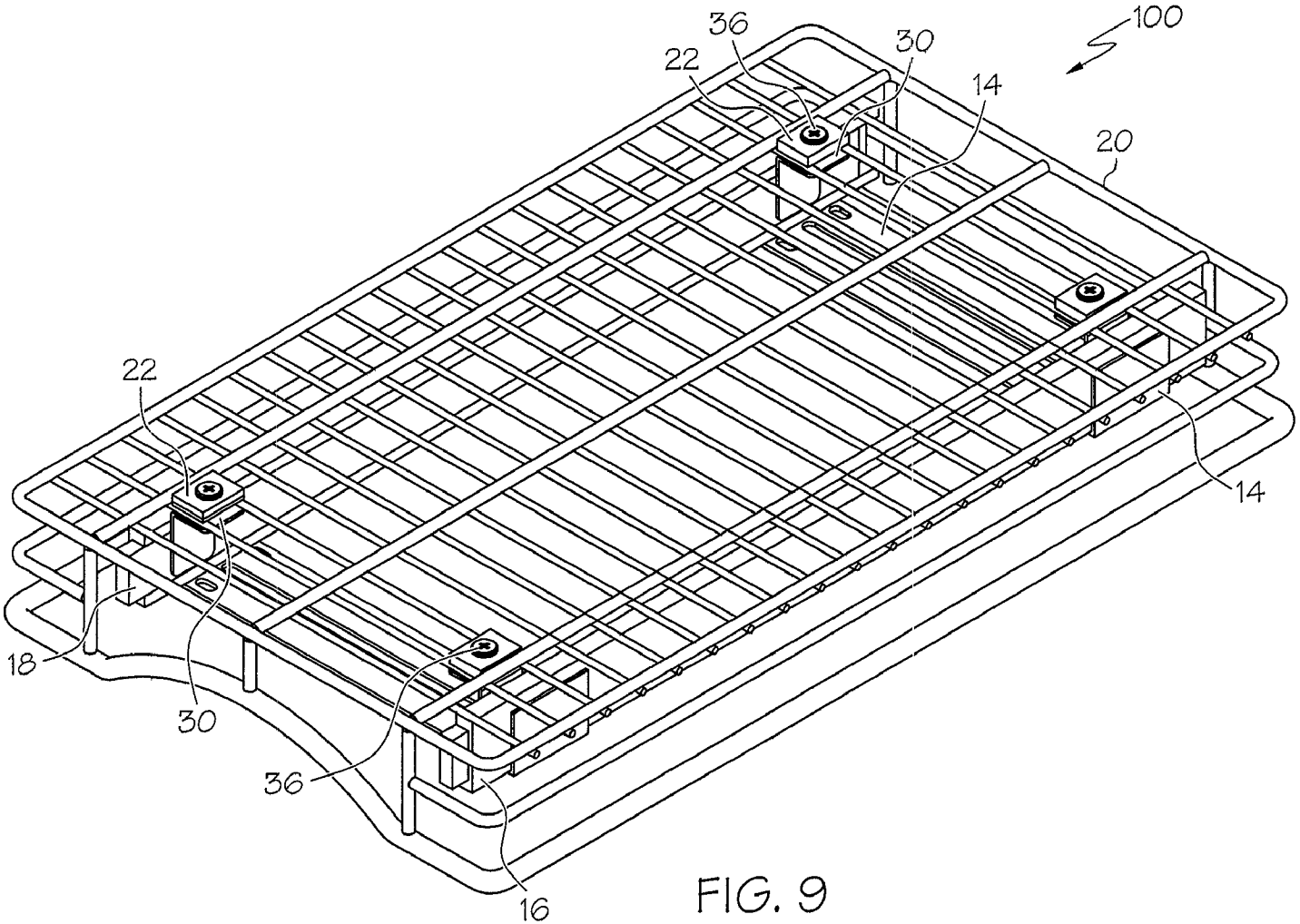
FIG. 9 is a bottom perspective view of the glide frame and drawer connected for packaging.
Figure 10:
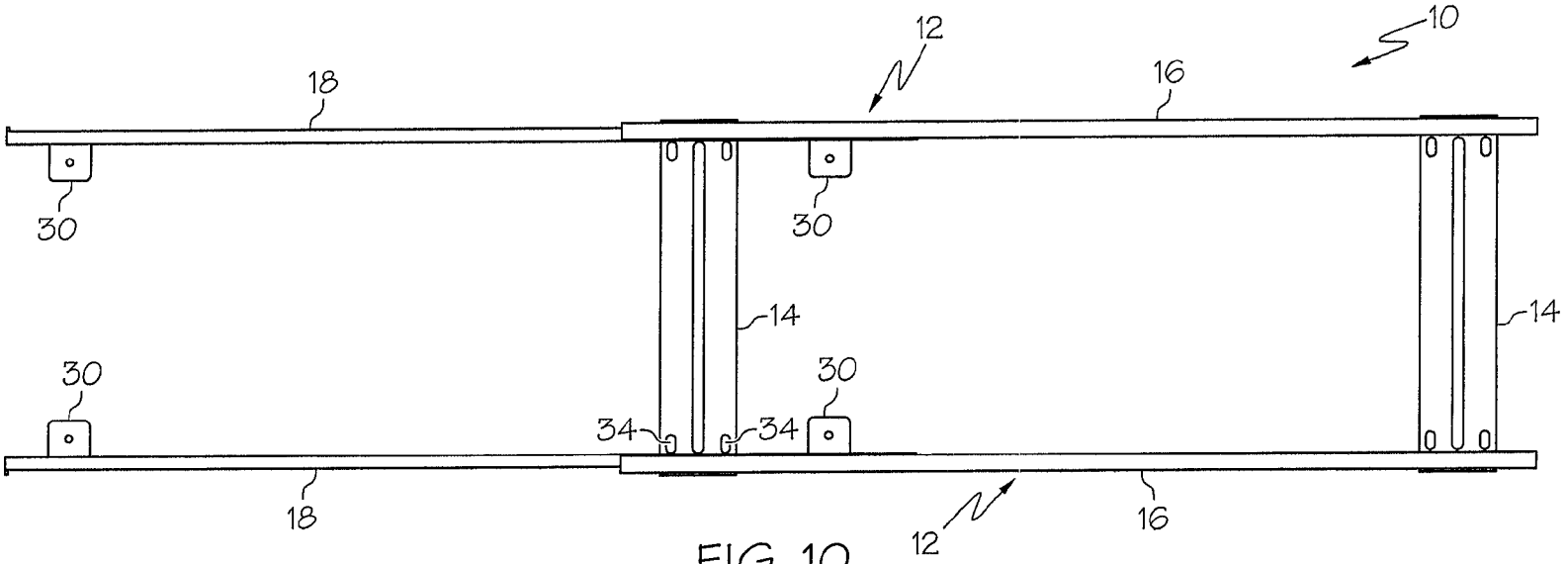
FIG. 10 is a top plan view of the glide frame of FIG. 1 without the drawer attached.

As best shown in FIG. 9, there may be four of the tabs 22 located generally near the four corner areas of the bottom of drawer 20. Likewise, as FIG. 12 best shows, the glide frame has four glide mounts 30, located near the front and back ends of each of the runners 18 and situated such that the tabs 22 align with the glide mounts 30. As will be described, the arrangement is symmetrical so that the glide mounts 30 align with the tabs 22 when the drawer is assembled, and also if the glide frame is inverted and placed in the drawer 20 for packaging.

Figure 7:
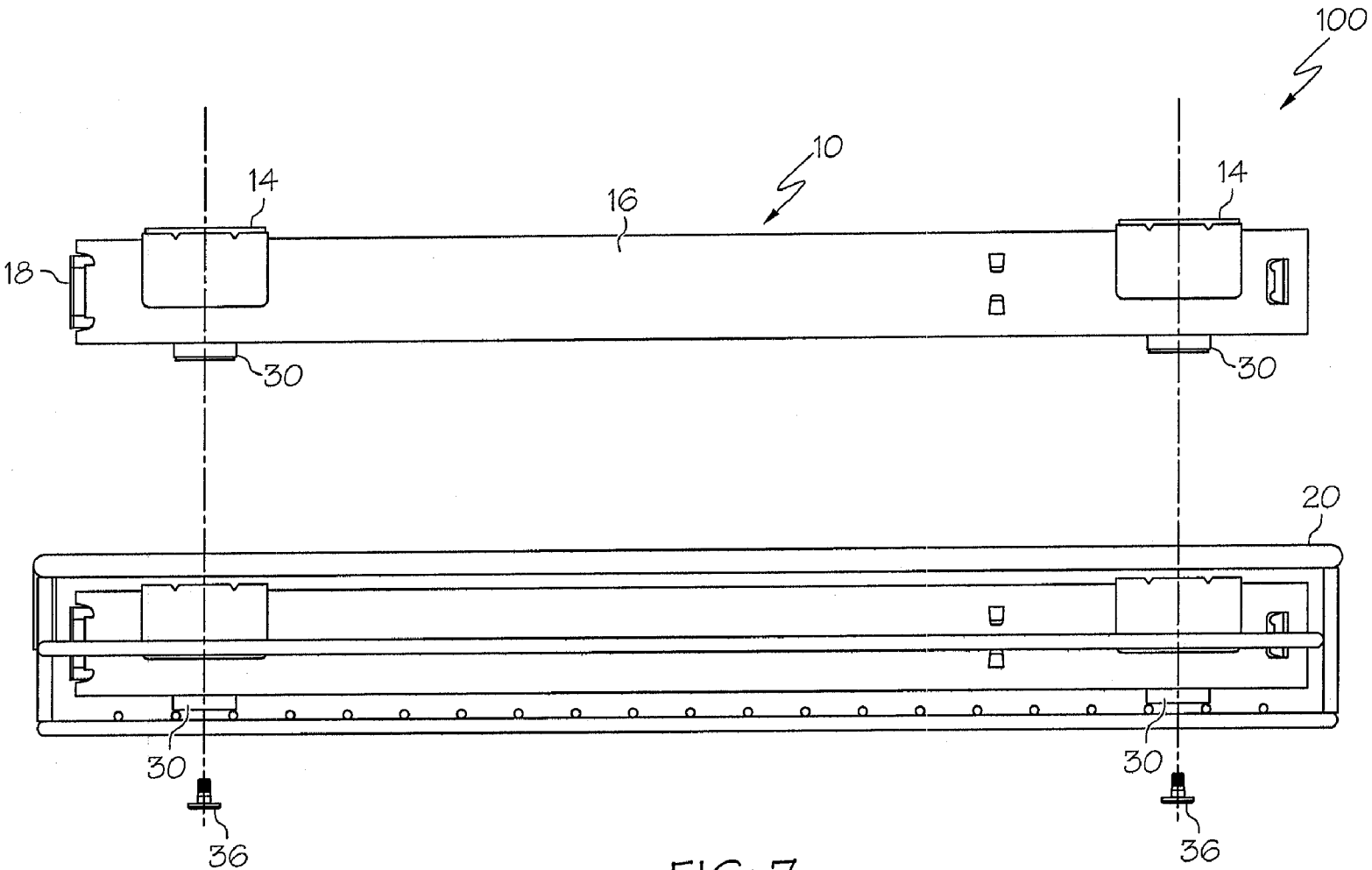
FIG. 7 is a side elevational view of a glide frame and drawer according to an embodiment of the present invention, with the broken lines showing how the glide frame can be attached inside of the drawer for packaging.
Figure 8:
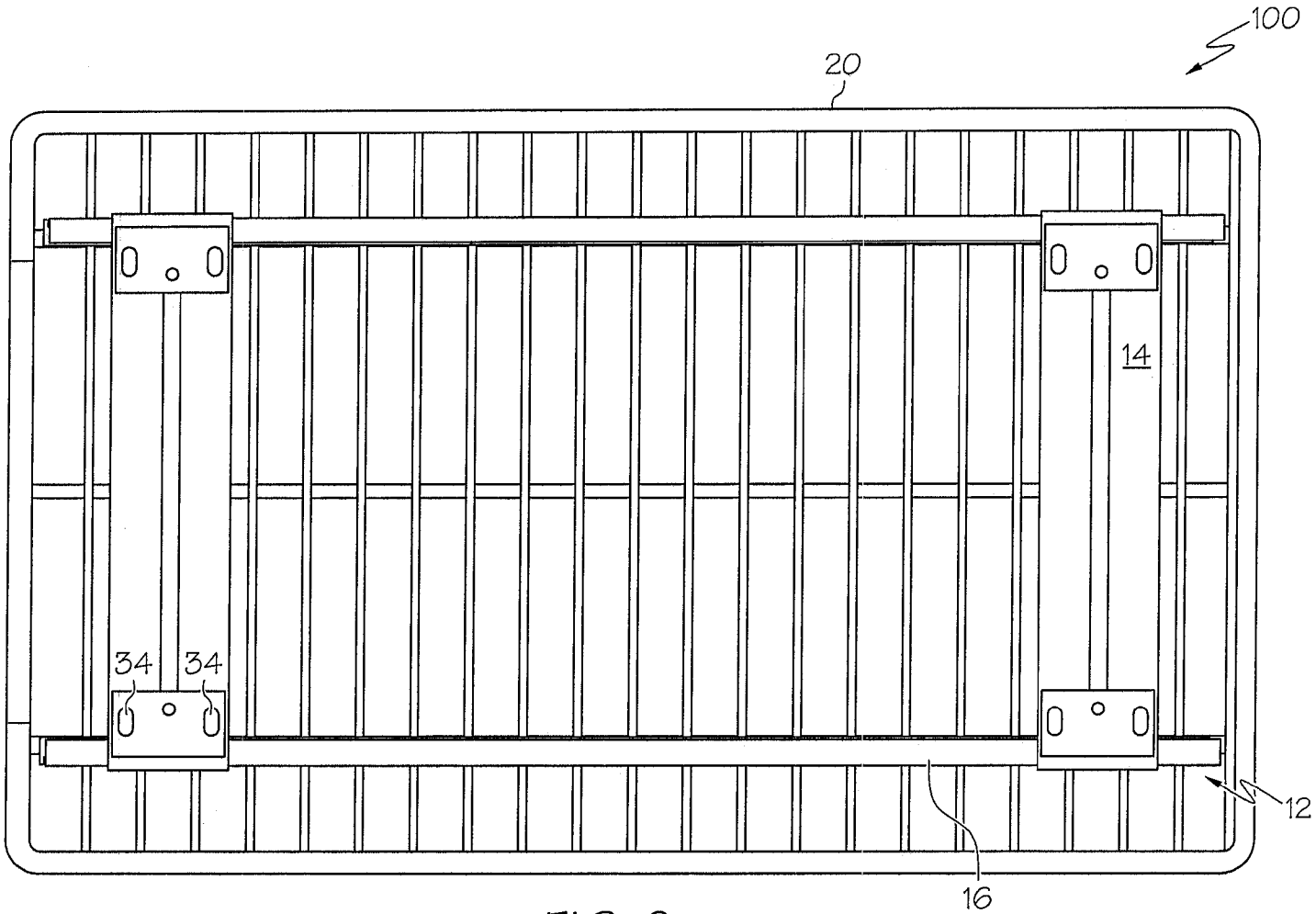
FIG. 8 is a top plan view of the glide frame and drawer connected for packaging.

FIGS. 7-9 best illustrate how the glide frame 10 fits inside of the drawer 20 for packaging and shipping. When configured for packaging, the glide frame 10 is inverted and positioned inside of the drawer 20 with the glide mount plates 30*a* of mounts 30 immediately overlying tabs 22, and the glide frame is secured to the drawer by connecting the glide mounts 30 to the drawer tabs 22 using screws 36. The pads 26 may be sandwiched between the tabs 22 and glide mounts 30. The major benefit of this shipping configuration is that packaging the glide frame 10 in the drawer 20 provides a more compact arrangement than would be the case if the drawer 20 were attached to the top of the glide frame 10 in the final installed configuration or packaged separately. An advantage of the compact arrangement is reduced shipping costs. Another advantage is that the compact arrangement makes efficient use of limited shelf space that is available in the case of retail sales and/or storage of the product.

Figure 11:
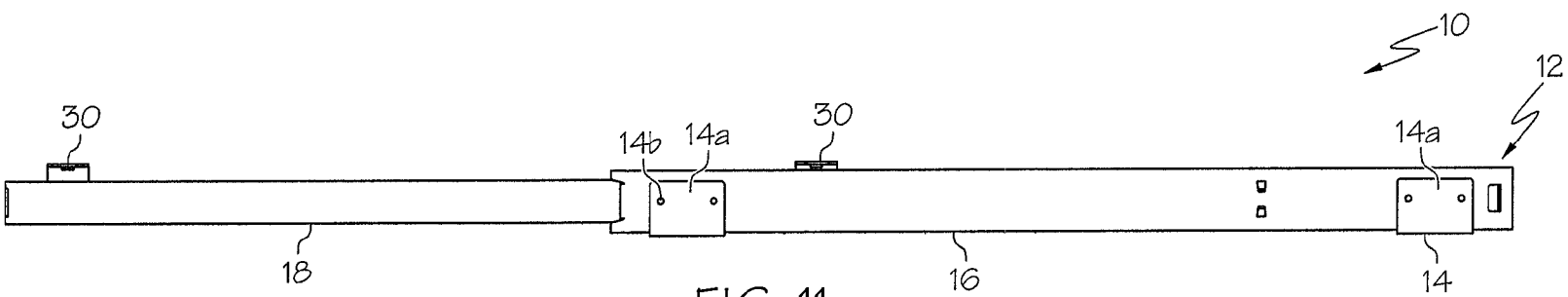
FIG. 11 is a side elevational view of the glide frame of FIG. 10.
Figure 12:
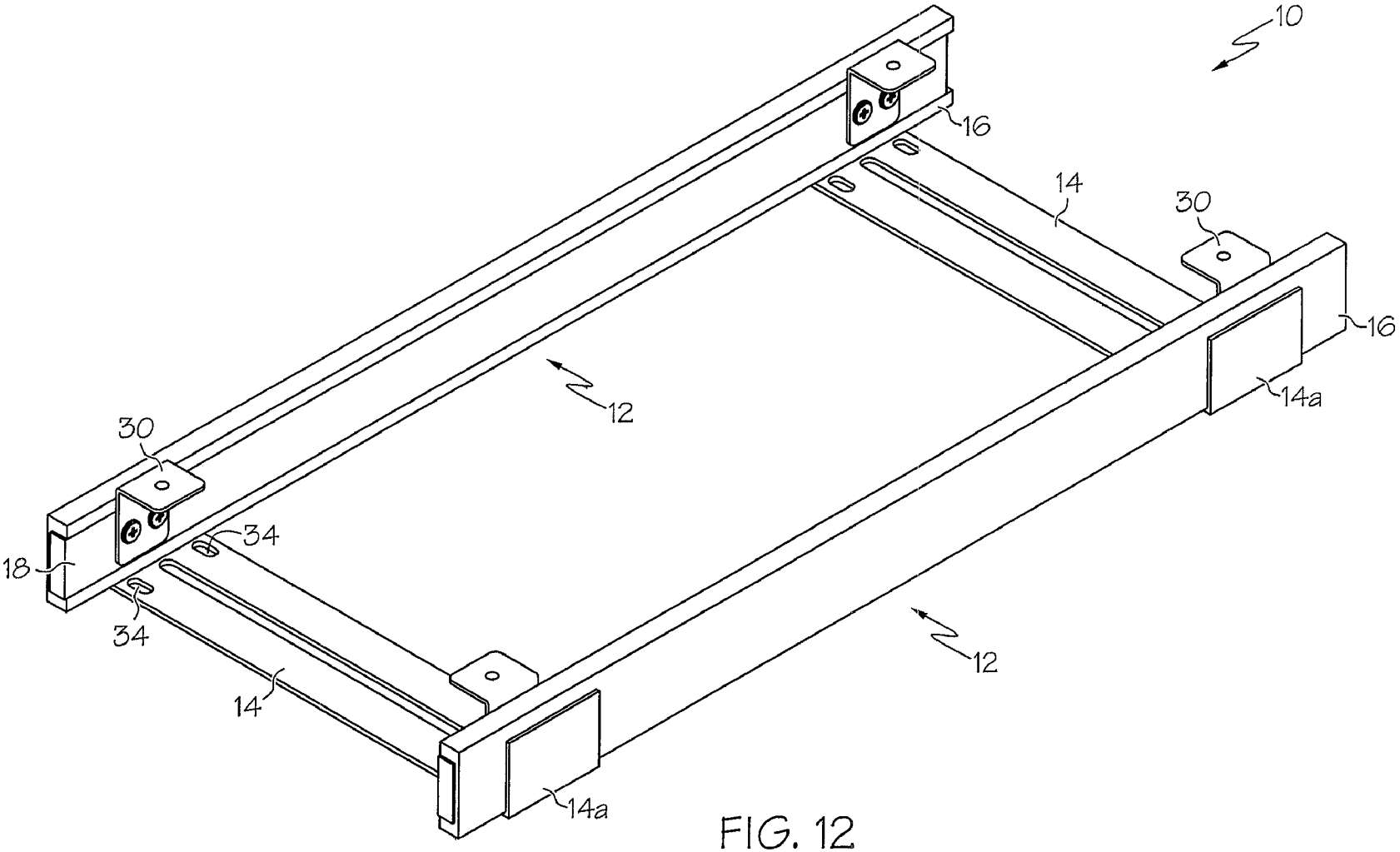
FIG. 12 is a perspective view of the glide frame of FIG. 10.
Figure 13:
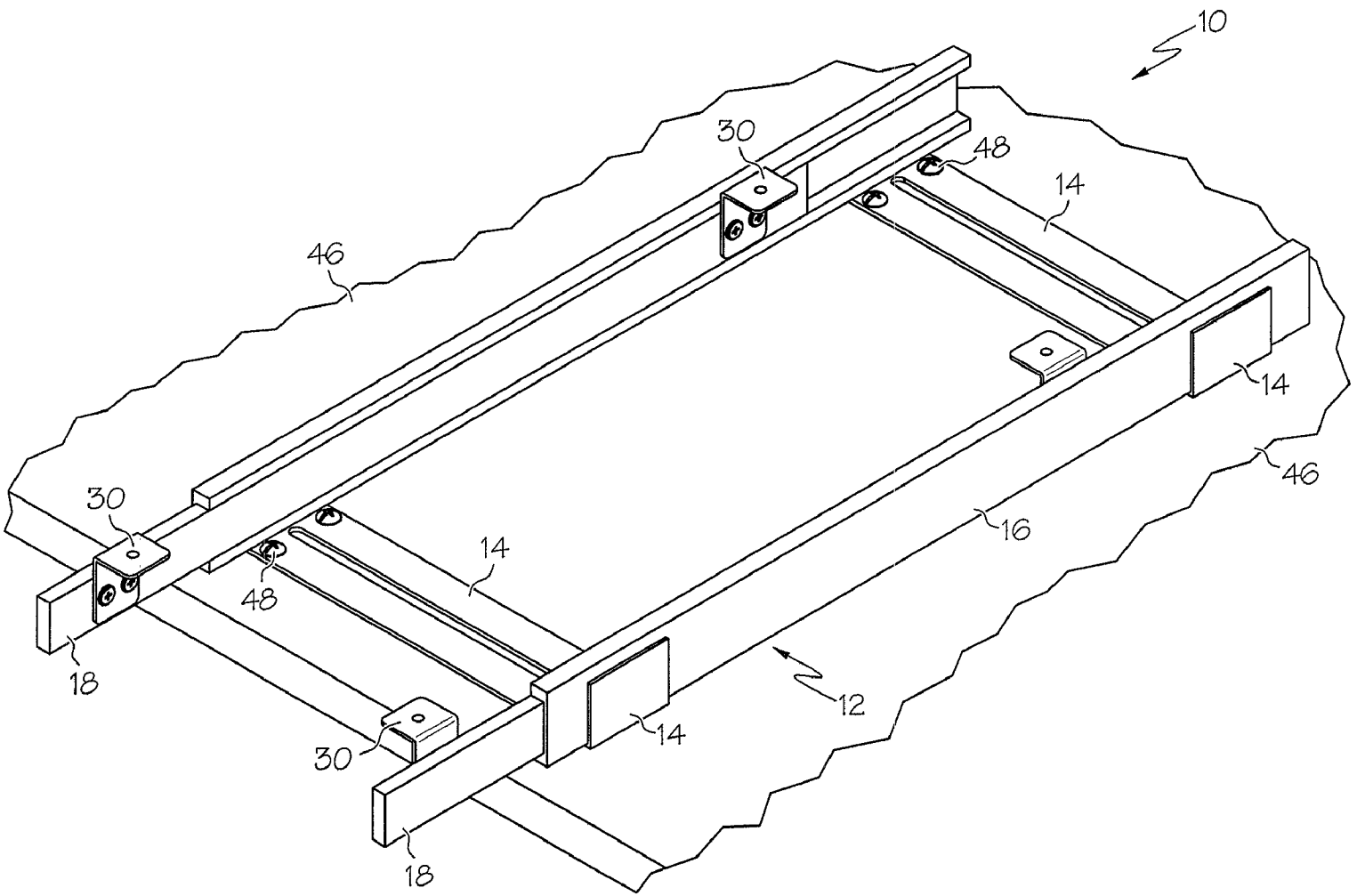
FIG. 13 is a perspective view of the glide frame of FIGS. 1 and 10-12 installed inside of a cabinet, with the glide runner partially extended.
Figure 14:
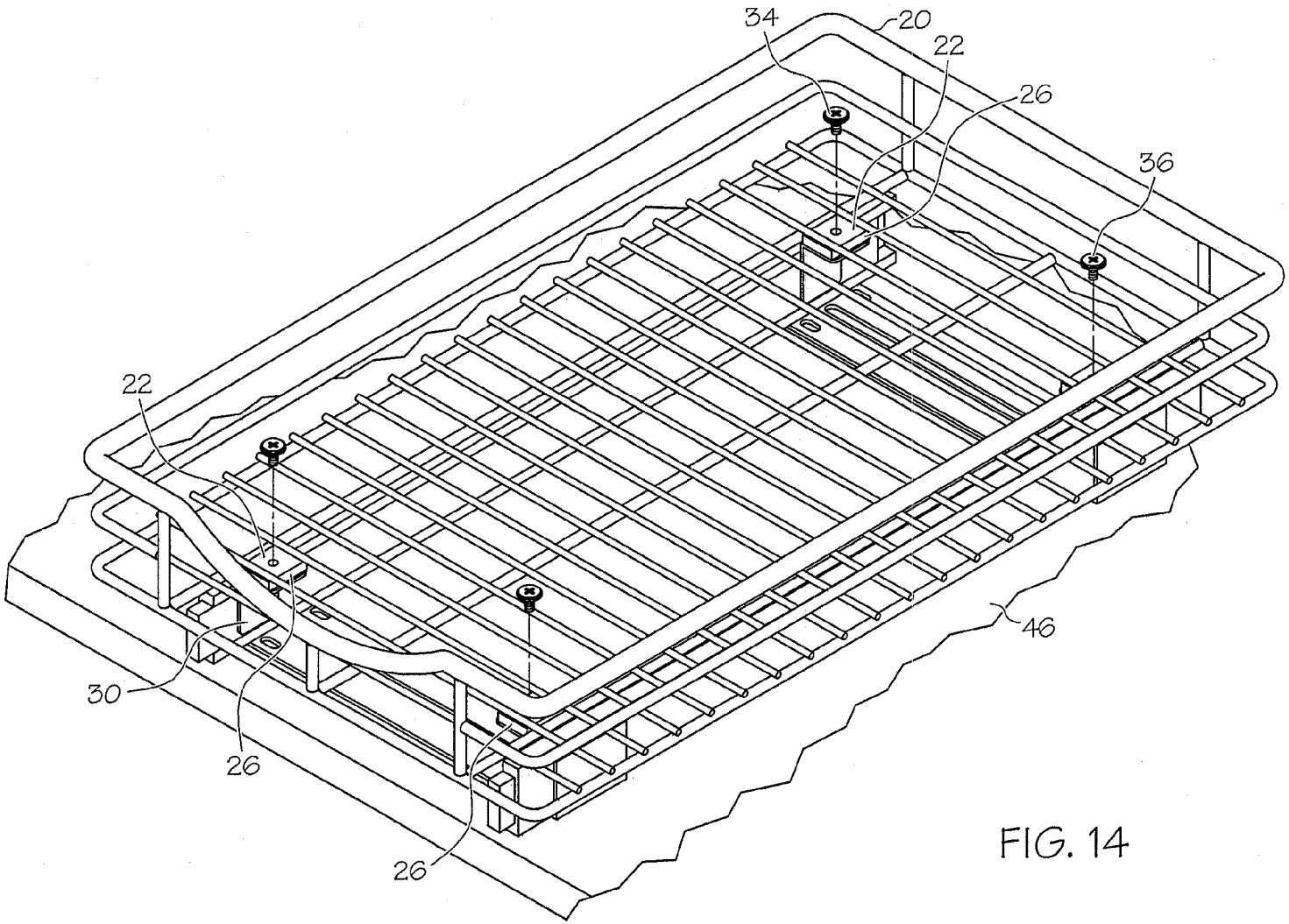
FIG. 14 is a perspective view of a drawer attached to the glide frame of FIG. 13.

With particular reference to FIGS. 11 and 12, the rigidity of the cross-bars 14 and their connections to tracks 16 is enhanced by upturned flanges 14*a* on the ends of cross-bars 14 which extend upwardly along the outer surfaces of tracks 16 and are secured to the tracks by rivets 14*b* (FIG. 11) or any other suitable manner. The glide frame 10 is installed by extending screws 48 through apertures 34 (see FIG. 13) in the cross-bars 14 and threading the screws 48 into the base 46 of a cabinet or other mounting surface. The cross-bars 14 may be ribbed for enhanced rigidity, and the apertures 34 may be provided in any suitable number and configuration.

The cross-bars 14 may be marked to indicate which way the glide frame 10 should be oriented in a cabinet. An advantage of providing a fully assembled glide frame 10 in accordance with the present invention is that the fully assembled glide frame can be pre-aligned and set at the factory which eliminates the need for installation templates of the type commonly required to install other glide mechanisms. Another advantage is that the fully assembled glide frame 10 allows the end user to handle and install one glide assembly as opposed to having to navigate the installation and alignment of two separate glides. Also, the glide frame is installed independently before installation of the drawer. This eliminates the problem of the drawer hindering access to the limited space typically available for installation inside a cabinet.

While it is preferable for the pads 26 to be located between the drawer and glides as shown and described, an installation wherein the pads are located and compressed between the glides and the cabinet or other mounting support is also advantageous, in that the floating suspension of the glides on the support provides similar "give" or "play" allowing the assembly to overcome any tendency for the glides to bind. In such an installation, the drawer or other accessory may be rigidly connected, may be connected using a floating-type suspension, or another type of connection may be employed.

Another embodiment of the invention is identical to what has been previously described, except that the pads 26 are eliminated. The tabs 22 can move up and down relative to the glide mounts 30 due to the use of the shoulder screws 36. In this embodiment, the universal relative movement described previously for the accessory is provided, compensating for the inevitable misalignment problems that have been mentioned. Although this embodiment is satisfactory in some applications, the inclusion of the pads is generally preferred to provide a better "feel" in most applications and prevent rattling and other noise.

Figure 15:
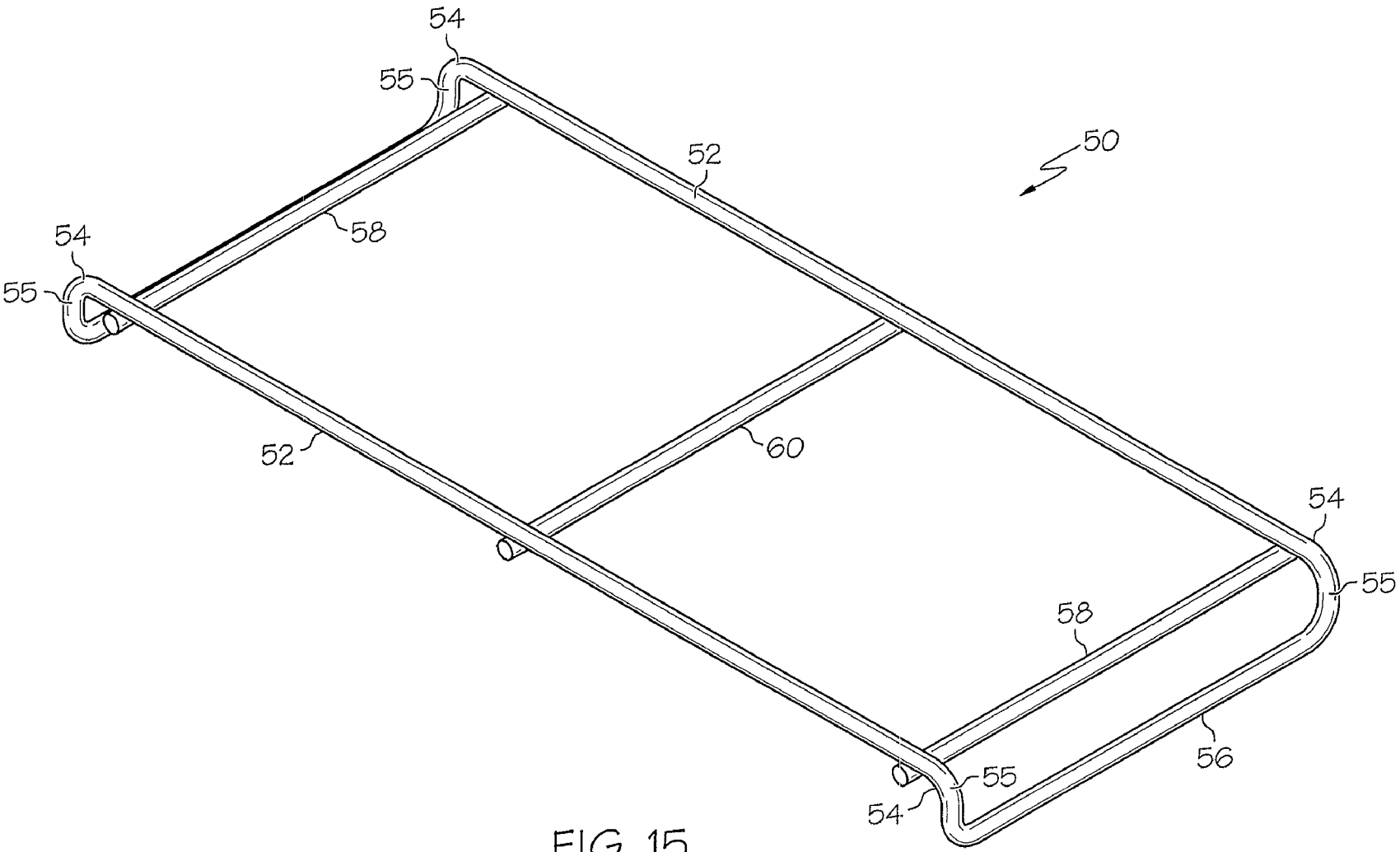
FIG. 15 is a perspective view of a two compartment drawer divider according to an embodiment of the present invention.
Figure 16:
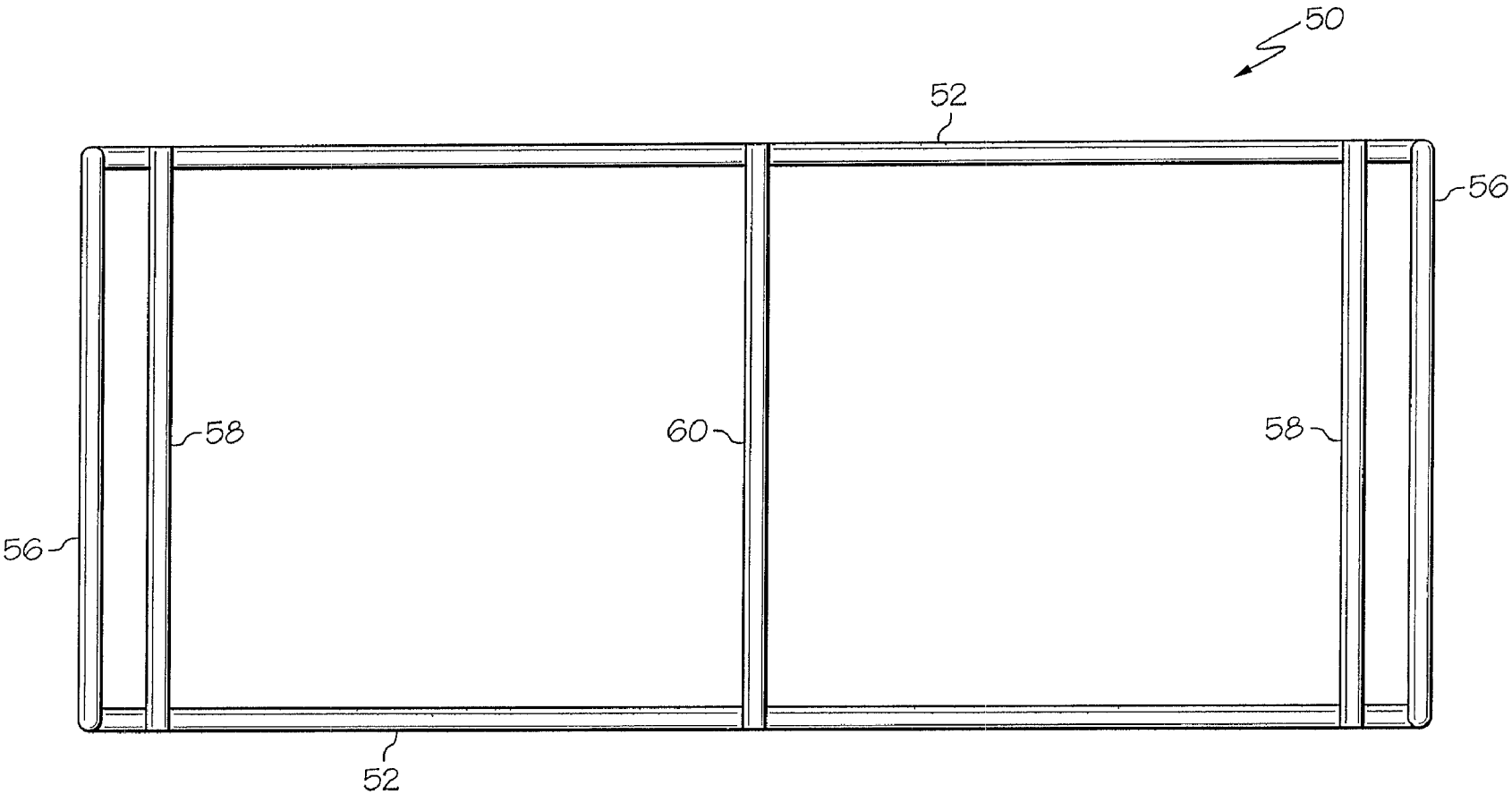
FIG. 16 is a bottom plan view of the two compartment drawer divider of FIG. 15.
Figure 17:
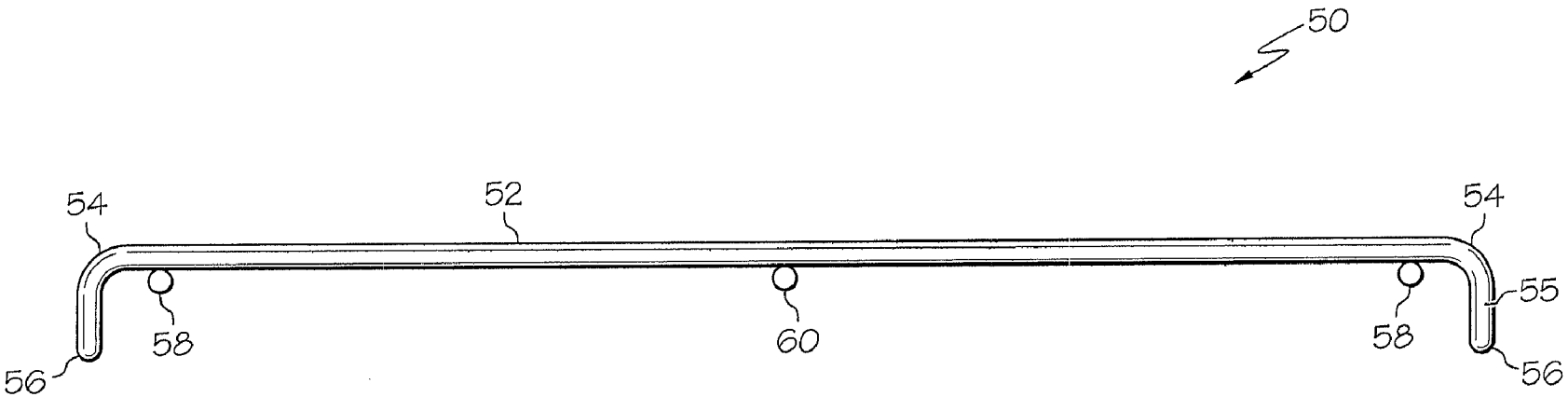
FIG. 17 is a side elevational view of the two compartment drawer divider of FIG. 15.

FIG. 15 depicts a two compartment drawer divider 50 which is exemplary of another aspect of the present invention. The divider 50 has a generally rectangular shaped wire frame which may be made from one continuous piece of wire. This frame may be comprised of two parallel lateral sections 52 having on their ends curved corners or hooks 54 that are bent downwardly to provide saddle configurations. Extending downwardly from and merged with each curved corner or hook is a short vertical leg 55. The bottoms of the legs 55 are bent approximately 90 degrees to form outer saddle wires 56 extending longitudinally and generally parallel to one another at both ends of the lateral sections 52.

Figure 18:
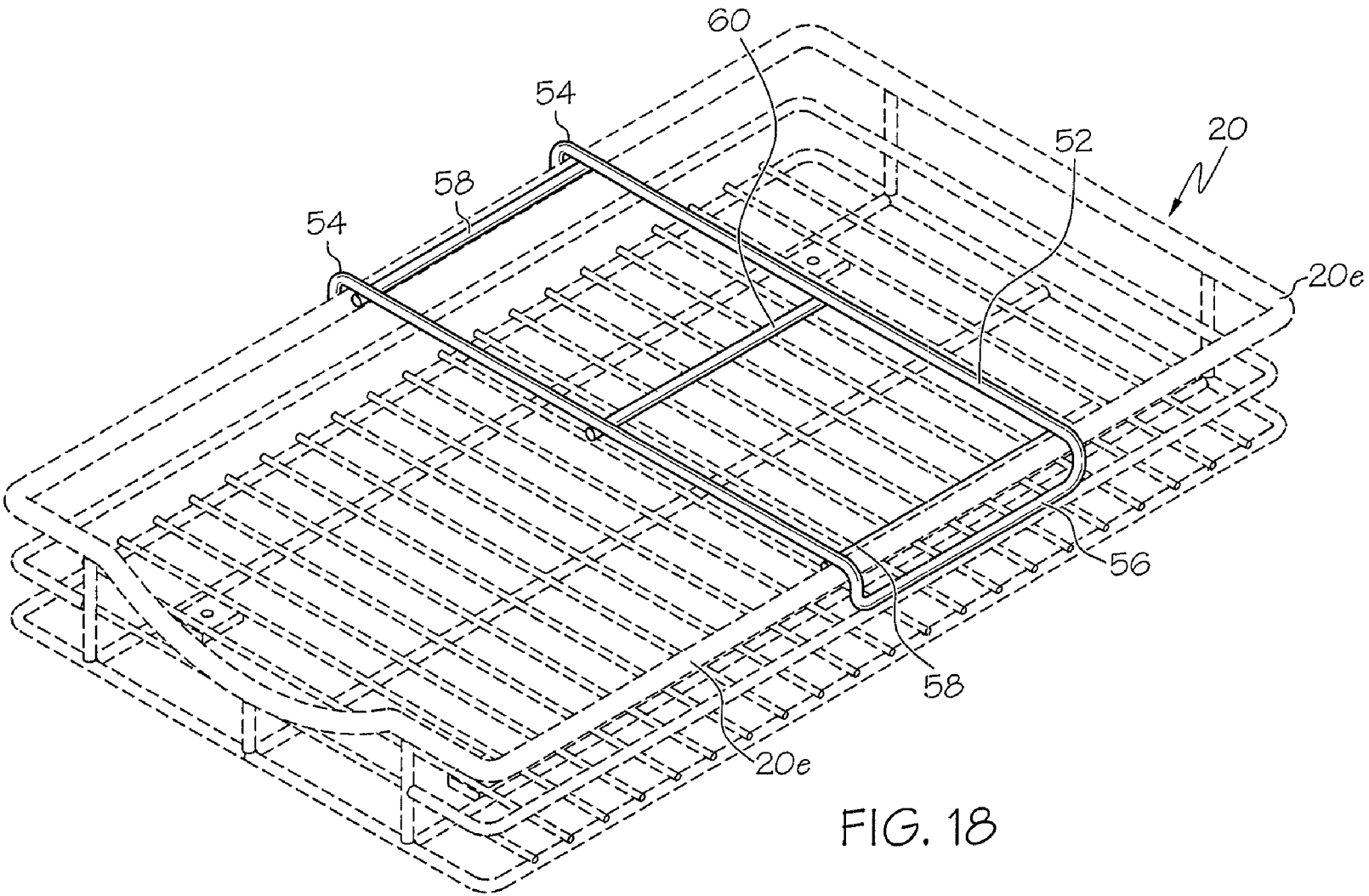
FIG. 18 is a perspective view of a two compartment drawer divider attached in accordance with one embodiment of the invention to a drawer shown in broken lines.

The lateral sections 52 are of a length that the divider 50 may span the top opening of drawer 20 (side-to-side or front-to-back) with the hooks 54 hooking onto the sides of the top rim 20*e*, as shown in FIG. 18 (or the front and back of the top rim 20*e*). Adjacently inward of each hook 54, an inner saddle wire 58 spans the lateral sections 52. The inner saddle wires 58 are generally parallel to the outer wires 56 and fit against the inner edge of drawer rim 20*e* when the divider 50 is applied to the drawer.

The divider 50 further includes an interior central partition 60 which spans the lateral sections 52 in an orientation that is substantially parallel to the inner saddle wires 58 and the outer saddle wires 56 at the approximate centers of the lateral sections 52. The partition 60 compartmentalizes the divider 50 into two areas located between the inner saddle wires 58. The divider may be provided with a plurality of interior partitions which compartmentalize the divider into several smaller areas. The divider 50 may lack a partition and form a single compartment that is bounded by the inner saddle wires 58 and the lateral sections 52.

The divider 50 can be installed at any position to extend crossways or lengthwise (or another direction) on a drawer to provide one or more separate compartments and to prevent items from tipping or moving. The divider also serves as an organizer to separate different items. Another advantage of the dividers of the present invention is that they can be installed at any position fore and aft along a drawer or similar roll out accessory (or side-to-side if the divider is installed to extend front-to-back on the drawer). One or more dividers can be installed on a drawer at any desired location, and each divider can have one or more compartments.

FIG. 18 shows the two compartment drawer divider 50 installed on a drawer 20 (shown in broken lines). When the divider is installed on the drawer, the curved hooks 54 fit closely on the opposite sides of the upper drawer rim 20*e* to secure the divider in place. The inner saddle wires 58 and the vertical legs 55 are positioned on either side of the top rim 20*e* of the drawer to assist in holding the divider on the drawer.

Figure 19:
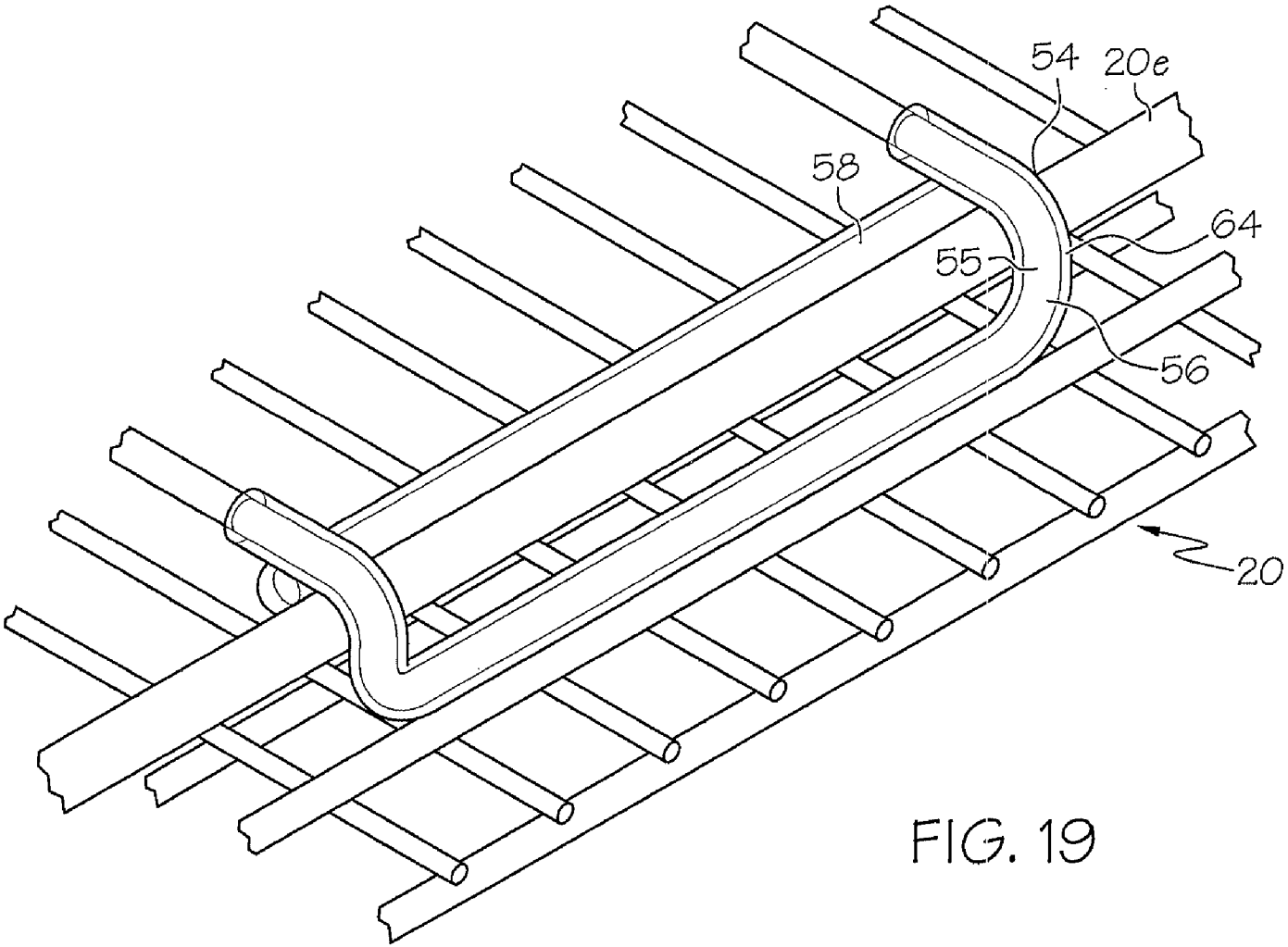
FIG. 19 is a fragmentary perspective view on an enlarged scale showing the manner in which the two compartment drawer divider may be attached to a drawer.

As shown best in FIG. 19, any or all of the inner saddle wires 58, the hooks 54, the legs 55 and the outer saddle wires 56 may be covered with a coating 64. The wires may be coated with a frictional coating (such as a rubbery vinyl plastic, for example) to enhance the frictional holding power and the grip of the saddle structure on the sides of the rim 20*e* (or other portion of the drawer). The combination of the saddle configuration provided by the hooks 54, the legs 55 and the inner and outer saddle wires 58 and 56, together with the friction coating 64, provides a secure connection of the divider 50 on the drawer while accommodating easy re-positioning of the dividers, all without the need for fasteners or tools.

The coating 64 may be a material that is tacky, such as vinyl, where the material has a high coefficient of friction, or it may be any other suitable friction-enhancing material. It will also be appreciated that it is possible to vary the degree of friction which is used to hold the divider in place along the top edge or another portion of a drawer by adjusting the degree to which the hooks are bent downward, by adjusting the distance between the inner saddle wires and the legs 55, by adjusting the lengths of the wires, or by varying the thickness and type of coating.

An advantage of the saddle or hook design of the present invention, in conjunction with the grip-like coating, is that a divider can capture and hold its position on a roll-out drawer 100 or other accessory without any need for clamps, fasteners or tools. At the same time, the divider can be quickly and easily removed and/or repositioned. The dividers may be used to secure/organize dish soap bottles, kitchen cleaning containers, narrow food containers, cooking containers, spice containers, and many other items. Additionally, one or more dividers can be used per drawer or other roll-out accessory. Use of the dividers of the present invention provides the advantage of being easily repositioned at will into an infinite number of positions to allow for changing storage needs.

While the divider 50 shown and described functions well, other configurations are possible. For example, the inner saddle wires 58 can be eliminated, as can the outer saddle wires 56. Such an arrangement relies on the hooks 54 and the integral legs 55 to hold the dividers in place, with or without a friction coating. In some applications, a divider formed by a single lateral wire section 52 with hooks 54 and legs 55 on its opposite ends (with or without a friction coating) may be used to form separate compartments on opposite sides of the lateral section.

Likewise, in some application there is no need for curved hooks, and the divider can take the form of one or more lateral sections 52 with legs turned downwardly at a right angle or other angle from the opposite ends of the lateral section such that the legs apply an inward force against the outside surfaces of the wires of rim 20*e* to hold the divider in place on the drawer, with or without a friction coating. In this arrangement, the legs may be equipped with short cross members (not shown) fitting partly beneath the rim 20*e,* or with other means for assisting in holding the divider in place on the drawer, again with or without a friction coating. Instead of engaging the rim 20*e,* the divider may be attached to wire 20*h* or another part of the drawer 20 or other accessory.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

We claim:

1. A rollout accessory apparatus comprising:

an accessory;

a glide frame having a pair of glides each including a track and a runner connected with said track via a ball-bearing system so as to allow the runner to extend and retract relative to said track, said tracks being substantially parallel;

at least one glide mount on each glide;

at least two mounting surfaces associated with said accessory and arranged to substantially align with said glide mounts, each said mounting surface including a first horizontally-elongated aperture therethrough that presents an elongated length along a first side-to-side dimension and an oversized width along a first front-to-back dimension, wherein the length along said first side-to-side dimension is larger than the width along said first front-to-back dimension;

a compressible pad between each said glide mount and mounting surface, each said pad including a second horizontally-elongated aperture therethrough that presents an elongated length along a second side-to-side dimension and an oversized width along a second front-to-back dimension, wherein the length along said second side-to-side dimension is larger than the width along said second front-to-back dimension, wherein said first and second horizontally-elongated apertures are generally aligned and are of the same general shape and size; and a screw extending at least partially through each said first aperture of each said mounting surface and each said second aperture of each said compressible pad to connect each said mounting surface to said respective glide mount, said screw having a shank, and said shank having a diameter that is smaller than the lengths of each of the first and second apertures so as to allow movement of each respective mounting surface relative to the respective glide along the side-to-side dimensions, and further wherein the shank's diameter is smaller than the oversized width of the apertures so as to allow movement of the respective mounting surface relative to the respective glide along the front-to-back dimensions, wherein said movement along the side-to-side and front-to-back dimensions occurs during retraction and extension of the runner with respect to the track.

2. Apparatus as set forth in claim 1, wherein said pad is operable to allow movement of the accessory relative to the glide frame in a generally vertical direction, wherein the elongated length and the oversized width of the first and second apertures in combination with the pad presents an accessory operable to move, during retraction and extension of the accessory relative to the glide frame, along a first generally horizontal axis in the side-to-side dimension, a second generally horizontal axis in the front-to-back dimension, and a generally vertical axis due to the pad.

3. Apparatus as set forth in claim 2, wherein said glide mount and said mounting surface present substantially flat surfaces facing one another with said pad interposed between said flat surfaces.

4. Apparatus as set forth in claim 2, wherein said screw provides a threaded connection between said mounting surface and glide mount, said screw having a shoulder providing a limit to said threaded connection to limit compression of said pad.

5. Apparatus as set forth in claim 4, wherein:

said accessory presents a bottom surface on which items are held; and said screw is recessed in its entirety at a location not to project above said bottom surface.

6. Apparatus as set forth in claim 1, wherein said glide frame further includes a pair of cross bars extending between and connected to said pair of glides and maintaining said glides substantially parallel.

7. Apparatus as set forth in claim 6, wherein said glides have a vertical orientation.

8. Apparatus as set forth in claim 1, wherein said accessory comprises a drawer.

9. Apparatus as set forth in claim 8, wherein said drawer is constructed of interconnected wires.

10. Apparatus as set forth in claim 1, wherein said screw is configured to move along said entire length of the first and second apertures in said side-to-side dimension, and further wherein said screw is configured to move along said entire width of the first and second apertures in said side-to-side dimension during said retraction and extension of the runner with respect to the track.

11. A rollout accessory apparatus comprising:

an accessory;

a glide frame having a pair of glides each including a track and a runner connected with said track via a ball-bearing system so as to allow the runner to extend and retract relative to said track, said tracks being substantially parallel;

at least one glide mount on each glide;

at least two mounting surfaces on said accessory arranged to substantially align with said glide mounts, each said mounting surface including a first horizontally-elongated aperture therethrough;

a compressible pad between each said glide mount and mounting surface, each said pad including a second horizontally-elongated aperture therethrough, wherein said first and second horizontally-elongated apertures are generally aligned and are of the same general shape and size; and a fastener connecting each said mounting surface to said respective glide mount with said respective pad compressed between said mounting surface and glide mount, said fastener extending through each of said first and second horizontally-elongated apertures so as to allow movement of said mounting surface relative to said glide mount in a first generally horizontal direction encompassing a length of the first and second elongated apertures, each said compressible pad allowing movement of said mounting surface relative to said glide mount in a generally vertical direction.

12. Apparatus as set forth in claim 11, wherein said aperture of each said mounting surface and of each said compressible pad further includes an oversized width in a second generally horizontal direction.

13. Apparatus as set forth in claim 12, wherein each said fastener comprises a shoulder screw providing a threaded connection between said mounting surface and the glide mount aligned therewith, said shoulder screw having a shoulder providing a limit to said threaded connection to limit compression of each pad.

14. Apparatus as set forth in claim 13, said screw having a shank, and said shank having a diameter that is smaller than the length of each aperture so as to allow movement of each respective mounting surface relative to the respective glide in the first generally horizontal direction, and further wherein the shank's diameter is smaller than the oversized width of each aperture so as to allow movement of the respective mounting surface relative to the respective glide in the second generally horizontal direction.

15. Apparatus as set forth in claim 14, wherein each of said glide mounts and each of said mounting surfaces has a substantially flat surface facing said pad.

16. Apparatus as set forth in claim 15, wherein:

tabs are connected to a bottom of said accessory; and said screw is located such that it does not project above said bottom of said accessory.

17. Apparatus as set forth in claim 14, wherein said length of each aperture is greater than said width of each aperture.

* * * * *